US008570355B2

(12) United States Patent
Murota

(10) Patent No.: US 8,570,355 B2
(45) Date of Patent: Oct. 29, 2013

(54) OPTICAL WRITING UNIT AND IMAGE FORMING APPARATUS FOR PERFORMING ENHANCED OPTICAL WRITING

(75) Inventor: Koichi Murota, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 86 days.

(21) Appl. No.: 13/229,982

(22) Filed: Sep. 12, 2011

(65) Prior Publication Data

US 2012/0069127 A1 Mar. 22, 2012

(30) Foreign Application Priority Data

Sep. 16, 2010 (JP) ..... 2010-207750

(51) Int. Cl.
*B41J 2/435* (2006.01)
*B41J 2/47* (2006.01)

(52) U.S. Cl.
USPC ..... 347/237; 347/247

(58) Field of Classification Search
USPC ..... 347/232–235, 237, 247–250, 238
See application file for complete search history.

(56) References Cited

U.S. PATENT DOCUMENTS 6,493,019 B1 * 12/2002 Hirasawa ..... 347/233
6,762,784 B2 * 7/2004 Skillman ..... 347/239

FOREIGN PATENT DOCUMENTS

JP 2009-262435 11/2009

* cited by examiner

*Primary Examiner* — Hai C Pham
(74) *Attorney, Agent, or Firm* — Oblon, Spivak, McClelland, Maier & Neustadt, L.L.P.

(57) ABSTRACT

An optical writing unit includes a plurality of light emitting element arrays, a plurality of clock signal generators, and a plurality of light emitting element controllers. The plurality of light emitting element arrays includes a plurality of light emitting elements aligned in one direction to project light. The plurality of clock signal generators generates image data transfer clock signals having different frequencies. The plurality of light emitting element controllers outputs the image data transfer clock signals received from the plurality of the clock signal generators and image data signals to the plurality of the light emitting element arrays to light up the light emitting elements based on the image data signals. The optical writing unit performs optical writing using light projected from the light emitting element arrays and controlled by the light emitting element controller based on the image data signals.

8 Claims, 3 Drawing Sheets

OPTICAL WRITING UNIT AND IMAGE FORMING APPARATUS FOR PERFORMING ENHANCED OPTICAL WRITING

CROSS-REFERENCE TO RELATED APPLICATIONS

This patent application is based on and claims priority pursuant to 35 U.S.C. §119 to Japanese Patent Application No. 2010-207750, filed on Sep. 16, 2010, in the Japan Patent Office, the entire disclosure of which is hereby incorporated herein by reference.

BACKGROUND OF THE INVENTION

1. Field of the Invention

Exemplary aspects of the present invention generally relate to an image forming apparatus, such as a copier, a facsimile machine, a printer, or a multi-functional system including a combination thereof, and more particularly, to an optical writing unit and an image forming apparatus including same.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

Typically, an electrophotographic image forming apparatus forms an electrostatic latent image on a photoconductive drum using an optical writing unit that illuminates the photoconductive drum with a light beam. As a light source for the light beam, the optical writing unit includes a light emitting element (LED) array head consisting of a plurality of light emitting elements, for example, light emitting diodes aligned in a certain direction. Based on image data signals, lighting of each LED is controlled, and the projected light is focused onto the photoconductive drum through a lens array, thereby writing the electrostatic latent image on the surface of the photoconductive drum.

In such an image forming apparatus, when a write controller that controls projection of light from the LED array head transfers the image data signal to the LED array head, radiated electric field noise is generated in the signal line which can cause adjacent instruments to malfunction. For this reason, the level of an electromagnetic interference (EMI) needs to be suppressed within a permissible level.

In view of the above, a known optical writing unit employs a regulator to reduce a swing level of the image data signals, thereby reducing the level of EMI generated in the signal line from the write controller to the LED array head.

Another known approach to reducing the level of EMI uses a spread spectrum technique to transfer the image data signal and an image data transfer clock signal.

Although advantageous and generally effective for their intended purpose, there is a drawback to the known approaches in that the swing level of the image data signal drops, thus degrading a signal-to-noise (S/N) ratio of the image data signal upon transfer. As a result, the quality of the image data signal is degraded.

In a case in which the image data signal and the image data transfer clock signal are transferred using the spread spectrum technique, in order to drive four LED heads, energy four times greater than when driving a single LED head is radiated. Consequently, even when the image data signal and the image data transfer clock signal for each LED head is spread, the EMI level still spikes.

Therefore, there is a demand for an optical writing unit that can reduce the EMI level upon transfer of the image data signal without degrading the S/N ratio.

BRIEF SUMMARY OF THE INVENTION

In view of the foregoing, in one illustrative embodiment of the present invention, an optical writing unit includes a plurality of light emitting element arrays, a plurality of clock signal generators, and a plurality of light emitting element controllers. The plurality of light emitting element arrays includes a plurality of light emitting elements aligned in one direction to project light. The plurality of clock signal generators generates image data transfer clock signals having different frequencies. The plurality of light emitting element controllers outputs the image data transfer clock signals received from the plurality of the clock signal generators and image data signals to the plurality of the light emitting element arrays to light up the light emitting elements based on the image data signals. The optical writing unit performs optical writing using light projected from the light emitting element arrays and controlled by the light emitting element controllers based on the image data signals.

In another illustrative embodiment of the present invention, an optical writing unit includes projecting means for projecting light, generating means for generating image data transfer clock signals having different frequencies, and output means for outputting the image data transfer clock signals received from the generating means and image data signals to the projecting means, to light up the projecting means based on the image data signals. The optical writing unit performs optical writing using light projected from the projecting means and controlled by the output means based on the image data signals.

In yet another illustrative embodiment of the present invention, an image forming apparatus includes means for bearing an electrostatic latent image, means for developing the electrostatic latent image using toner to form a toner image, means for transferring the toner image onto a recording medium, means for fixing the toner image on the recording medium, and the optical writing unit.

Additional features and advantages of the present invention will be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF THE INVENTION

Figure 1:
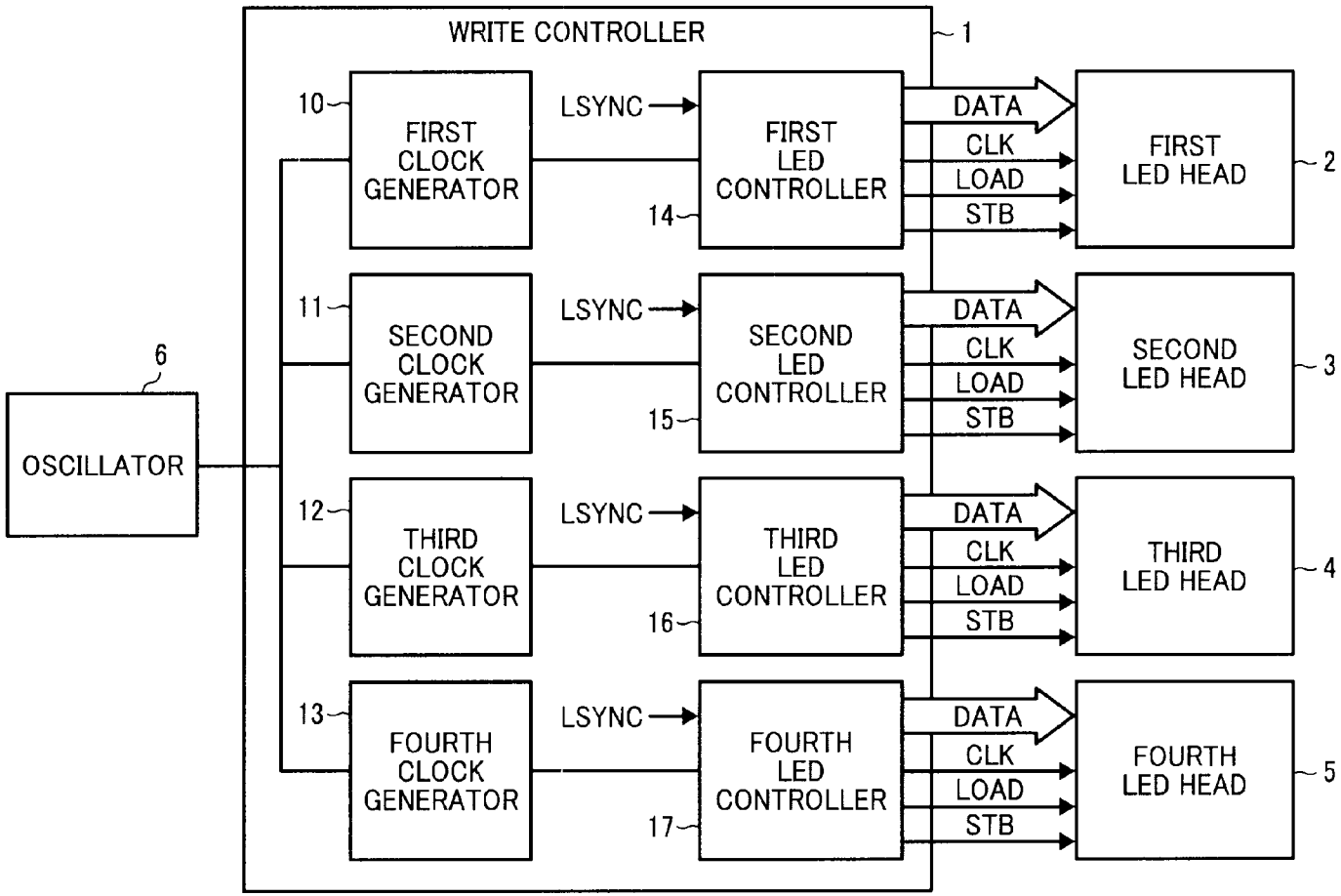
FIG. 1 is a block diagram of an optical writing unit according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 2:
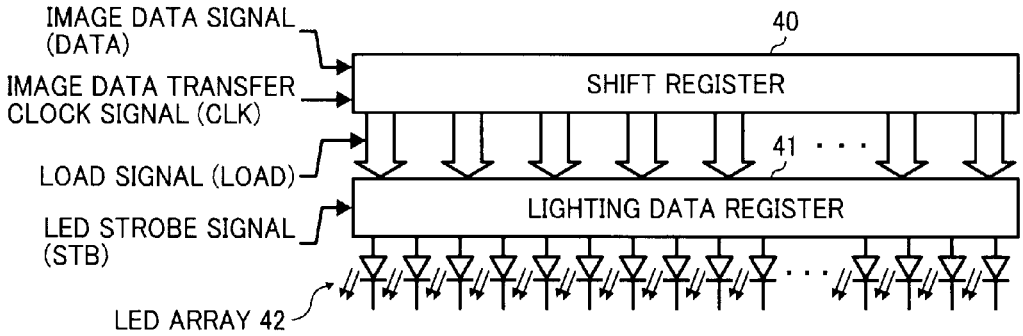
FIG. 2 is a block diagram of a first LED head through a fourth LED head employed in the optical writing unit of FIG. 1.
Figure 3:
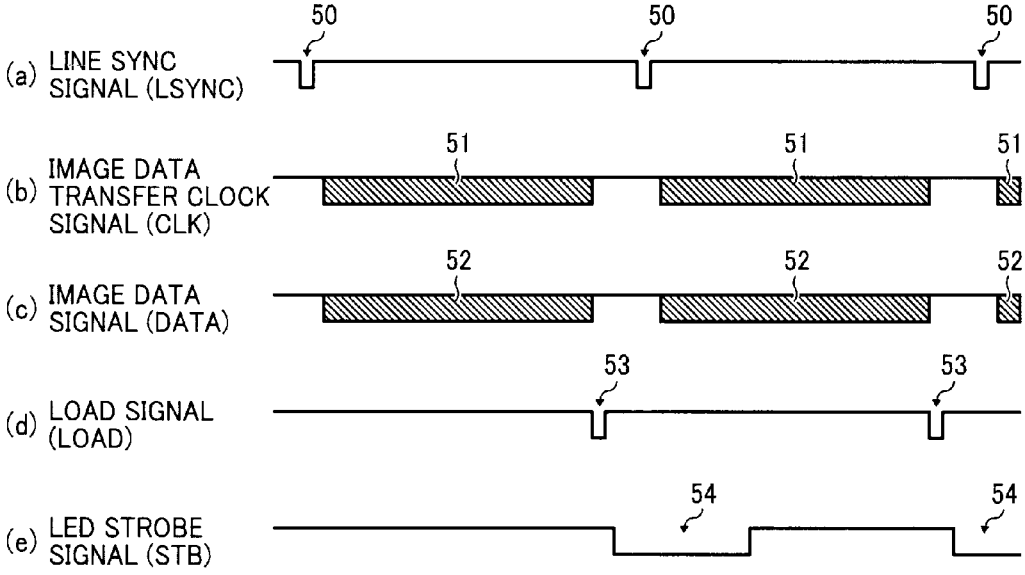
FIG. 3 is a timing diagram for signals output from a first LED controller through a fourth LED controller to the first LED head through the fourth LED head of FIG. 2.

Referring now to the drawings, wherein like reference numerals designate identical or corresponding parts throughout the several views, and initially with reference to FIGS. 1 through 3, a description is provided of the optical writing unit according to an illustrative embodiment of the present invention.

FIG. 1 is a block diagram of the optical writing unit. FIG. 2 is a block diagram of a first LED head 2 through a fourth LED head 5 employed in the optical writing unit of FIG. 1. FIG. 3 is a timing diagram for signals output from a first LED controller 14 through a fourth LED controller 17 to the first LED head 2 through the fourth LED head 5 of FIG. 2.

The optical writing unit is implemented as a microprocessor/computer consisting of a CPU, a ROM, and a RAM. As illustrated in FIG. 1, the optical writing unit includes a write controller 1, the first LED head 2, a second LED head 3, a third LED head 4, the fourth LED head 5, and an oscillator 6. The write controller 1 includes a first clock generator 10, a second clock generator 11, a third clock generator 12, a fourth clock generator 13, the first LED controller 14, a second LED controller 15, a third LED controller 16, and the fourth LED controller 17. As illustrated in FIG. 2, each of the first LED head 2 through the fourth LED head 5 includes a shift register 40, a lighting data register 41, and an LED array 42.

The write controller 1 controls emission of light from the first LED head 2 through the fourth LED head 5. The write controller 1 controls the first LED head 2 through the fourth LED head 5 to project a light beam to write optically. The oscillator 6 generates a reference clock signal for producing an image data transfer clock signal (CLK) to be output as a sync signal when the write controller 1 outputs image data to the first LED head 2 through the fourth LED head 5.

Based on the reference clock signal received from the oscillator 6, each of the first clock generator 10 through the fourth clock generator 13 of the write controller 1 generates and outputs an image data transfer clock signal of different frequencies within a range of EMI measurement (equivalent to "a range of radiated electric field noise frequency") to the respective LED controllers 14 through 17.

Each of the first LED controller 14 through the fourth LED controller 17 receives a line sync signal (LSYNC) from an external device (for example, an image processor of the image forming apparatus), and outputs an image data signal (DATA) received from the external device and the image data transfer clock signal to the respective shift register 40 of the first LED head 2 through the fourth LED head 5. The first LED controller 14 through the fourth LED controller 17 provide the first LED head 2 through the fourth LED head 5 with a load signal (LOAD) to instruct start of transfer of the image data. The first LED controller 14 through the fourth LED controller 17 also provide the lighting data register 41 with an LED strobe signal (STB) to control lighting of the LED array 42.

The shift register 40 is a memory unit having a shift register structure that shifts a storage location of the image data based on the image data transfer clock signal. The shift register 40 shifts the storage location of the data based on the image data transfer clock received from the write controller 1, and accumulates the image data also received from the write controller 1. The accumulated image data is a data string indicating which LED in the LED array 42 is to be lit and which not lit. Furthermore, the shift register 40 moves the image data stored in the shift register 40 to the lighting data register 41 based on the load signal received from the write controller 1.

As the lighting data register 41 accumulates the image data received from the shift register 40 and receives a strobe signal from the write controller 1, the LED of the LED array 42 corresponding to the data indicating the place in the image data to be lit is lit for a certain duration during which the strobe signal is input. In the meantime, the LED of the LED array 42 corresponding to the data indicating the place in the image data to be not lit is not lit for a certain duration during which the strobe signal is input. The LED array 42 includes a plurality of LED arrays each having a plurality of light emitting elements such as LEDs aligned in a certain direction.

The write controller 1 of the optical writing unit provides the reference clock signal output from the oscillator 6 to the first clock generator 10 through the fourth clock generator 13. Based on the reference clock signal received from the write controller 1, the first clock generator 10 through the fourth clock generator 13 generate image data transfer clock signals of different frequencies and output the image data transfer clock signals to the corresponding LED controllers, that is, the first LED controller 14 through the fourth LED controller 17.

As illustrated in FIG. 3, when the first LED controller 14 through the fourth LED controller 17 receive a line sync signal (LSYNC) 50 (FIG. 3, (a)) from an external device, not illustrated, the first LED controller 14 through the fourth LED controller 17 output an image data transfer clock signal (CLK) 51 (FIG. 3, (b)) received from the first clock generator 10 through the fourth clock generator 13 and an image data signal (DATA) 52 (FIG. 3, (c)) received from the external device, to the shift register 40 of the first LED head 2 through the fourth LED head 5.

The shift register 40 of the first LED head 2 through the fourth LED head 5 accumulate image data to be in synchronism with the image data transfer clock signal received from the write controller 1. After outputting the image data, the first LED controller 14 through the fourth LED controller 17 output a load signal (LOAD) 53 (FIG. 3, (d)) that moves the image data accumulated in the shift register 40 of the first LED head 2 through the fourth LED head 5 to the lighting data register 41.

Based on the load signal received from the write controller 1, the shift register 40 of the first LED head 2 through the fourth LED head 5 moves the accumulated image data to the lighting data register 41 which then accumulates the image data. After the image data is moved, the first LED controller 14 through the fourth LED controller 17 output an LED strobe signal (STB) 54 (FIG. 3, (e)) that lights up the LED array 42 based on the image data accumulated in the lighting data register 41 of the first LED head 2 through the fourth LED head 5.

Based on the LED strobe signal received from the write controller 1, the lighting data register 41 of the first LED head 2 through the fourth LED head 5 lights up the appropriate LEDs of the LED array 42 and do not light up other LEDs in accordance with the stored image data as long as the LED strobe signal is on.

According to the illustrative embodiment, the optical writing unit includes four LED heads. When employed in the image forming apparatus, the first LED head 2 through the fourth LED head 5 may correspond to color components of a color image, that is, yellow, magenta, cyan, and black, and illuminate photoconductors, one for each of the colors yellow, magenta, cyan, and black, with light. In this configuration, multiple electrostatic latent images of a respective single color are formed on the photoconductors.

In a case in which the number of LED heads is increased, the number of clock generators and LED controllers of the write controller 1 is increased accordingly, and the LED heads are operated similar to the foregoing embodiments. Accordingly, optical writing can be performed by four or more LED heads. For example, in a case in which optical writing of five colors is performed, five sets of an LED head, a clock generator, and an LED controller are provided. In a case in which optical writing of six colors is performed, six sets of an LED head, a clock generator, and an LED controller are provided, accordingly. If optical writing of more colors is performed, the same number of sets of the LED head, the clock generator, and the LED controller are provided and the same operation described above is performed. Accordingly, the same optical writing as using four LED heads can be performed.

As the first clock generator 10 through the fourth clock generator 13, a circuit such as a phase locked loop (PLL) may be employed. As long as the reference clock signal can be generated, the oscillator 6 may be any type of oscillator, including a crystal oscillator. The oscillator or the crystal oscillator may be connected to each of the first clock generator 10 through the fourth clock generator 13. The oscillator or the crystal oscillator may output reference clock signals of different frequencies. In such a case, the first clock generator 10 through the fourth clock generator 13 generate and output image data transfer clock signals each corresponding to the frequency of the respective reference clock signal being input. With this configuration, the first clock generator 10 through the fourth clock generator 13 can output the image data transfer clock signals of different frequencies.

As described above, the lighting timing of the LED of the LED array 42 is determined solely by the LED strobe signal (strobe signal). The image data transfer clock signal is not synchronized with the lighting timing of the LED of the LED array 42. Therefore, even when the image data transfer clock signals are different in the first LED head 2 through the fourth LED head 5, the image data written by the first LED head 2 through the fourth LED head 5 coincides. In other words, when printing out the image, color drift does not occur.

Harmonics of the image data transfer clock signals (CLK) each provided to the first LED head 2 through the fourth LED head 5 do not overlap in the radiated electric field noise measurement range, thereby preventing generation of radiated electric field noise without degrading the S/N ratio of the image data transfer signal.

For example, in a case in which a cycle of a line sync signal is 200 μs, the number of pieces of data of the first LED head 2 through the fourth LED head 5 is 10000 dots, and the image data is sent every 4 bits (dots), the lower limit of the image data transfer clock signal is: 1/(200/(10000/4))=12.5 MHz.

Considering the time and the margin of the load signal, the frequency of the image data transfer clock signal (the image data transfer clock signal to the first LED head 2) that is generated by the first clock generator 10 and output to the first LED controller 14 is 15.1 MHz. The frequency of the image data transfer clock signal (the image data transfer clock signal to the second LED head 3) that is generated by the second clock generator 11 and output to the second LED controller 15 is 15.2 MHz.

The frequency of the image data transfer clock signal (the image data transfer clock signal to the third LED head 4) that is generated by the third clock generator 12 and output to the third LED controller 16 is 15.3 MHz. The frequency of the image data transfer clock signal (the image data transfer clock signal to the fourth LED head 5) that is generated by the fourth clock generator 13 and output to the fourth LED controller 17 is 15.4 MHz. The measurement range of the EMI is up to 1 GHz. In this configuration, harmonics of each clock do not overlap.

Although not as much as changing every clock, if overlapping harmonics are of two sets or fewer within the radiated electric field noise measurement range, generation of the radiated electric field noise is suppressed without degrading the S/N ratio of the image data transfer signal.

Figure 4:
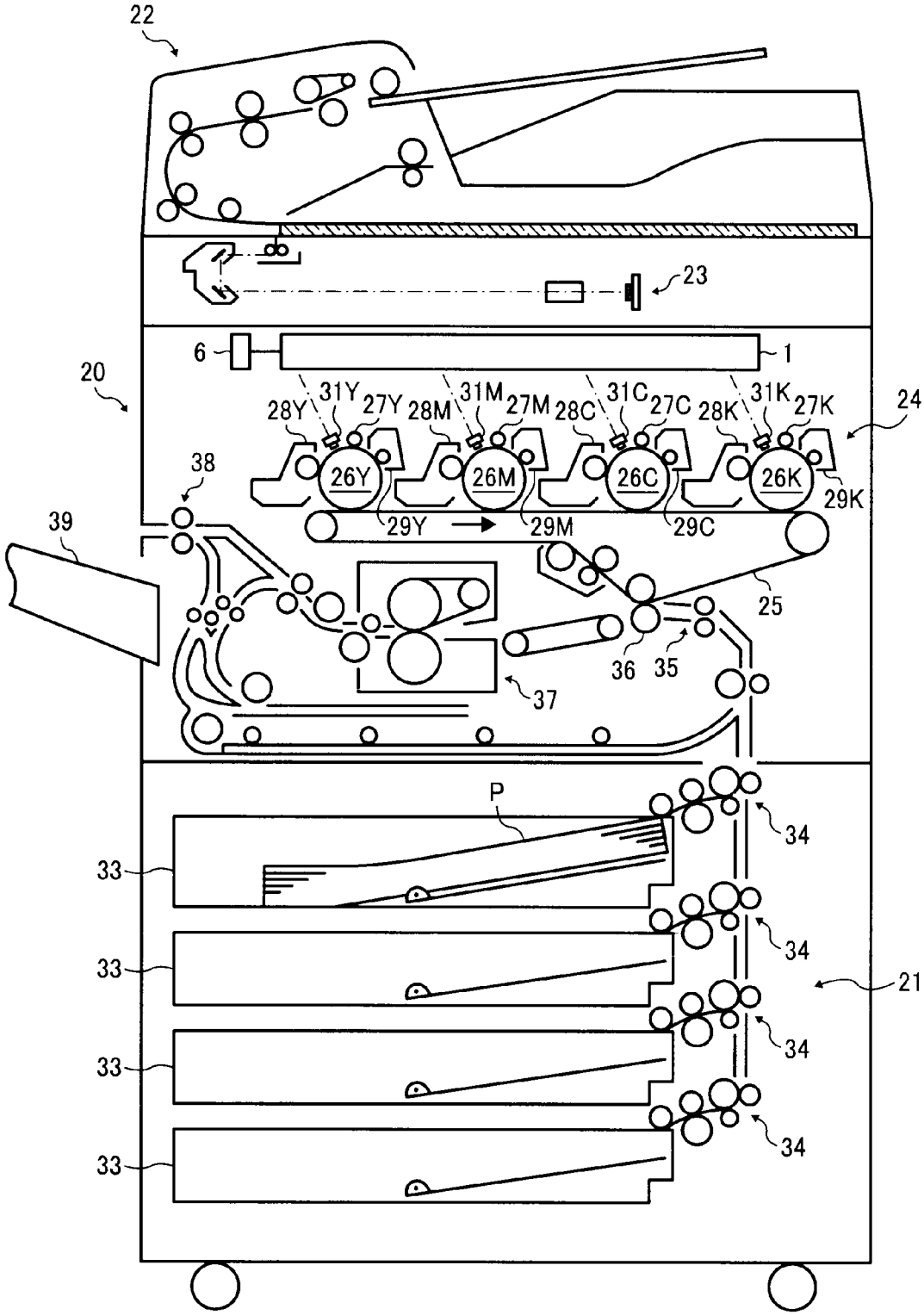
FIG. 4 is a schematic diagram illustrating a digital color copier as an example of an image forming apparatus according to an illustrative embodiment of the present invention.

With reference to FIG. 4, a description is provided of an image forming apparatus employing the optical writing unit according to an illustrative embodiment of the present invention. FIG. 4 is a schematic diagram illustrating a digital color copier as an example of the image forming apparatus according to the illustrative embodiment of the present invention.

An image forming apparatus 20 is a tandem-type color image forming apparatus which forms a color image. The image forming apparatus 20 includes a sheet feeding unit 21, a document feeder 22, a document reader 23, and an image forming unit 24.

The sheet feeding unit 21 includes a plurality of sheet cassettes 33 in which multiple recording media sheets P are stored. When printing or copying, a recording medium P in each sheet cassette 33 is fed to the image forming unit 24 by a sheet transport member 34. When reading an image of an original document, the document feeder 22 sends the document to the document reader 23. The document reader 23 serves as a scanner and includes a light source, a mirror, not illustrated, and so forth. The document reader 23 reads the image of the document transported from the document feeder 22, and the read image is converted to image data. The document reader 23 may employ known parts including a light source, a mirror, and so forth. Thus, a detailed description of each part in the document reader 23 is omitted.

The image forming unit 24 includes an intermediate transfer belt 25 and four photoconductors (which may, for example, be drum-type photoconductors known as photoconductive drums) 26Y, 26M, 26C, and 26K. The photoconductors 26Y, 26M, 26C, and 26K are disposed in tandem facing the intermediate transfer belt 25. It is to be noted that the suffixes Y, M, C, and K denote colors yellow, magenta, cyan, and black, respectively. Thereafter, these suffixes are omitted, unless otherwise specified. The photoconductor 26Y serves as an image bearing member on which a toner image of the color yellow (Y) is written. The toner image of yellow on the photoconductor 26Y is transferred onto the intermediate transfer belt 25. The photoconductor 26M serves as an image bearing member on which a toner image of the color magenta (M) is written. The toner image of magenta on the photoconductor 26M is transferred onto the intermediate transfer belt 25.

The photoconductor 26C serves as an image bearing member on which a toner image of the color cyan (C) is written. The toner image of cyan on the photoconductor 26C is transferred onto the intermediate transfer belt 25. The photoconductor 26K serves as an image bearing member on which a toner image of the color black (K) is written. The toner image of black on the photoconductor 26K is transferred onto the intermediate transfer belt 25.

The toner images formed on the photoconductors 26Y, 26C, 26M, and 62K are transferred onto the intermediate transfer belt 25 so that they are superimposed one atop the other, thereby forming a composite color toner image. The intermediate transfer belt 25 is wound around a plurality of rollers including a primary transfer bias roller, not illustrated, and formed into a loop so that it moves endlessly. The intermediate transfer belt 25, the plurality of rollers, a cleaning device, a secondary transfer backup roller, a cleaning backup roller, a tension roller, and so forth constitute an intermediate transfer unit. The constituent elements of the intermediate transfer unit except the intermediate transfer belt 25 may employ known devices.

The image forming unit 24 includes charging devices 27Y, 27M, 27C, and 27K, developing devices 28Y, 28M, 28C, and 28K, and cleaning devices 29Y, 29M, 29C, and 29K, each disposed around the respective photoconductors 26Y, 26M, 26C, and 26K. For example, the charging device 27Y, the developing device 28Y, and the cleaning device 29Y are disposed around the photoconductor 26Y. The charging devices 27Y, 27M, 27C, and 27K charge the surface of the photoconductors 26Y, 26M, 26C, and 26K. The developing devices 28Y, 28M, 28C, and 28K develop electrostatic latent images formed on the photoconductors 26Y, 26M, 26C, and 26K with respective colors of toner, thereby forming visible images, also known as toner images on the photoconductors 26Y, 26M, 26C, and 26K. The toner images are transferred onto the intermediate transfer belt 25 one atop the other as described above. Subsequently, the cleaning devices 29Y, 29M, 29C, and 29K recover residual toner remaining on the photoconductors 26Y, 26M, 26C, and 26K.

In the image forming unit 24, exposure devices 31Y, 31M, 31C, and 31K are disposed substantially above the respective photoconductors 26Y, 26M, 26C, and 26K. The exposure devices 31Y, 31M, 31C, and 31K illuminate the photoconductors 26Y, 26M, 26C, and 26K with light to form electrostatic latent images on the photoconductors 26Y, 26M, 26C, and 26K. According to the illustrative embodiment, the exposure devices 31Y, 31M, 31C, and 31K correspond to the first LED head 2, the second LED head 3, the third LED head 4, and the fourth LED head 5, respectively.

The image forming unit 24 includes the write controller 1 and the oscillator 6. The write controller 1 regulates emission of light of the exposure devices 31 (the LED heads 2 through 5). The oscillator 6 provides the write controller 1 with the reference clock signal (reference clock pulse signal).

Based on the reference clock signal and the image data from the oscillator 6, the write controller 1 regulates lighting of the LEDs of the exposure devices 31Y, 31M, 31C, and 31K. The projected light is focused onto the photoconductors 26Y, 26M, 26C, and 26K through lens arrays, not illustrated, thereby forming the electrostatic latent images thereon.

In a case of monochrome printing, a toner image of the color black formed on the photoconductor 26K is transferred onto the intermediate transfer belt 25.

The recording medium P transported from the sheet cassette 33 of the sheet feeding unit 21 by the transport member 34 is stopped temporarily by a pair of registration rollers 35 and is sent to a transfer roller 36 in appropriate timing such that the recording medium P is aligned with the toner image on the intermediate transfer belt 25. Then, the toner image is transferred from the intermediate transfer belt 25 onto the recording medium P.

Subsequently, the recording medium P bearing the toner image passes through a fixing device 37 so that the toner image is fixed onto the recording medium P. Then, the recording medium P is discharged onto a sheet discharge tray 39 by a sheet discharge roller 38.

According to the illustrative embodiment, the image forming apparatus 20 can form an image while suppressing radiated electric field noise without hindering the SN ratio of the image data transfer signal.

According to the illustrative embodiment, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An optical writing unit, comprising:

a plurality of light emitting element arrays including a plurality of light emitting elements aligned in one direction to project light;

a plurality of clock signal generators to generate image data transfer clock signals having different frequencies; and a plurality of light emitting element controllers to output the image data transfer clock signals received from the plurality of the clock signal generators and image data signals to the plurality of the light emitting element arrays to light up the light emitting elements based on the image data signals, wherein the optical writing unit performs optical writing using light projected from the light emitting element arrays and controlled by the light emitting element controllers based on the image data signals, wherein overlapping harmonics of the frequencies of the image data transfer clock signals are of two sets or fewer within a radiated electric field noise measurement range.

2. The optical writing unit according to claim 1, further comprising:

an oscillator to output a reference clock signal, wherein the plurality of the clock generators generates the image data transfer clock signals having different frequencies based on the reference clock signal.

3. The optical writing unit according to claim 1, further comprising:

a plurality of oscillators each corresponding to each of the plurality of the clock generators, to output reference clock signals having different frequencies, wherein the plurality of the clock generators generates image data transfer clock signals having different frequencies based on the reference clock signals output from the plurality of the oscillators.

4. An image forming apparatus, comprising:

an image bearing member to bear an electrostatic latent image on a surface thereof;

a developing device to develop the electrostatic latent image formed on the image bearing member using toner to form a toner image;

a transfer device to transfer the toner image onto a recording medium;

a fixing device to fix the toner image; and the optical writing unit according to claim 1.

5. An optical writing unit, comprising:

projecting means for projecting light;

generating means for generating image data transfer clock signals having different frequencies; and output means for outputting the image data transfer clock signals received from the generating means and image data signals to the projecting means, to light up the projecting means based on the image data signals, wherein the optical writing unit performs optical writing using light projected from the projecting means and controlled by the output means based on the image data signals, wherein overlapping harmonics of the frequencies of the image data transfer clock signals are of two sets or fewer within a radiated electric field noise measurement range.

6. The optical writing unit according to claim 5, further comprising:

means for outputting a reference clock signal, wherein the generating means generates the image data transfer clock signals having different frequencies based on the reference clock signal.

7. An image forming apparatus, comprising:

means for bearing an electrostatic latent image;

means for developing the electrostatic latent image using toner to form a toner image;

means for transferring the toner image onto a recording medium;

means for fixing the toner image on the recording medium; and the optical writing unit according to claim 5.

8. A method implemented by an optical writing unit, comprising:

generating, via a plurality of clock signal generators, image data transfer clock signals having different frequencies;

outputting, via a plurality of light emitting element controllers, the image data transfer clock signals received from the plurality of the clock signal generators and image data signals to a plurality of the light emitting element arrays having a plurality of light emitting elements aligned in one direction to project light to light up the light emitting elements based on the image data signals; and performing optical writing using light projected from the light emitting element arrays and controlled by the light emitting element controllers based on the image data signals, wherein overlapping harmonics of the frequencies of the image data transfer clock signals are of two sets or fewer within a radiated electric field noise measurement ranges.

* * * * *